United States Patent [19]

Frey-Wigger

[11] 4,418,791

[45] Dec. 6, 1983

[54] DEVICE FOR ENHANCING THE VERSATILITY OF CRANES OR THE LIKE

[76] Inventor: Paul Frey-Wigger, Am Zeigerwald, CH-6247 Schötz, Switzerland

[21] Appl. No.: 247,754

[22] Filed: Mar. 26, 1981

[30] Foreign Application Priority Data

Mar. 27, 1980 [CH] Switzerland ..... 2414/80

[51] Int. Cl.[3] ..... B66F 9/06; B66F 11/04

[52] U.S. Cl. ..... 182/2; 182/19; 182/63; 182/150; 414/607; 212/251

[58] Field of Search ..... 182/2, 63, 62.5, 150, 182/142, 18, 19, 112; 414/607, 713; 187/88, 89; 212/251

[56] References Cited

U.S. PATENT DOCUMENTS

| | | | |
|---|---|---|---|
| 1,337,487 | 4/1920 | Schlatter | 182/63 |
| 2,632,530 | 3/1953 | Wagner | 182/63 |
| 2,821,312 | 1/1958 | Wiegel | 182/2 |
| 3,039,233 | 6/1962 | Holmes | 182/63 |
| 3,504,461 | 4/1970 | Copeland | 182/2 |
| 3,608,669 | 9/1971 | Lindsay | 182/63 |
| 3,647,099 | 3/1972 | Carriere | 414/607 |
| 3,907,142 | 9/1975 | Welch | 414/607 |
| 3,966,070 | 6/1976 | Barth | 414/713 |
| 4,074,790 | 2/1978 | Colbachini | 182/150 |
| 4,154,318 | 5/1979 | Malleone | 182/63 |

*Primary Examiner*—Reinaldo P. Machado
*Attorney, Agent, or Firm*—Kontler, Grimes & Battersby

[57] ABSTRACT

The free end portion of the boom of a crane carries a separable pivot bearing defining a horizontal pivot axis for a second bearing which reciprocably guides an upright column for one or more galleries. When the cable which is used to lift or hold the column breaks and the column begins to rapidly descend, such movement of the column activates a composite brake mounted on a frame surrounding the column at a level above the second bearing. The brake holds the column against downward movement with reference to the frame whereby the frame tends to descend toward the second bearing against the opposition of several shock absorbers which reduce the likelihood of damage to and/or excessive swaying of the boom and/or injury to the occupant or occupants of the gallery. The speed of downward movement of the column is monitored by a detector which activates the brake as soon as the speed exceeds a preselected value.

21 Claims, 6 Drawing Figures

DEVICE FOR ENHANCING THE VERSATILITY OF CRANES OR THE LIKE

CROSS-REFERENCE TO RELATED CASES

The device of the present invention constitutes an improvement over and a further development of the attachment which is disclosed in commonly owned copending application Ser. No. 793,970 filed May 5, 1977 for "Working bridge", now U.S. Pat. No. 4,274,793 granted June 23, 1981.

Another attachment which is somewhat similar to the device of the present invention is disclosed in the commonly owned copending application Ser. No. 247,835 filed Mar. 26, 1981 and entitled "Attachment for the booms of cranes or the like".

BACKGROUND OF THE INVENTION

The present invention relates to cranes or analogous machines wherein an elongated boom, preferably an extensible and contractible boom, is movable about at least one axis (e.g., about a vertical axis and about a horizontal axis) so that its free end portion can be moved to a plurality of levels as well as in a plurality of horizontal planes. More particularly, the invention relates to improvements in attachments which can be separably or even permanently secured to the free end portion of the boom of a crane or a like machine to enhance the versatility of the machine by enabling it to carry out operations which are not expected from a conventional crane, scaffolding, fruit picker or the like. For example, a crane or an analogous machine which is equipped or combined with the attachment of the present invention can be utilized to move one or more workers close to the facedes of tall buildings, below the undersides of bridges or viaducts, adjacent to selected portions of tall chimneys or masts, adjacent to any selected portion at the exterior of a watercraft or aircraft, and/or adjacent to steep surfaces of cliffs or the like.

My copending application Ser. No. 793,970 discloses an attachment which is connectable to the free end portion of the boom of a crane or the like and includes a pivot bearing separably coupled to the boom, a second bearing pivotable in or relative to the pivot bearing about a horizontal axis, an elongated upright column which is reciprocable in the second bearing, and a gallery which is adjustably mounted on the column and is designed to carry one or more persons. The boom is preferably extensible and contractible and can also change its inclination in a vertical plane as well as about a vertical axis which is adjacent to or intersects its lower end portion. This enables the boom to move the gallery to hard-to-reach locations. A cable or the like is used to move the column up or down with respect to the second bearing so as to further enhance the versatility of the machine. Since the gallery is designed to accommodate at least one person and often a substantial number of persons, it is necessary to equip such machines with highly reliable safety devices which prevent the column and the gallery from becoming detached from the remainder of the attachment and/or from the boom in the event that the cable breaks. In the absence of such safety devices, attachments of the above outlined character would be banned by the relevant authorities in many countries, states, districts, cities, townships or other administrative units.

OBJECTS AND SUMMARY OF THE INVENTION

An object of the invention is to provide a novel and improved attachment for use on the booms of cranes or like machines which is equipped with an adequate safety system so that it can successfully withstand the scrutiny of strictest authorities.

Another object of the invention is to provide a novel and improved automatic braking system for the column of an attachment which can be coupled to the boom of a crane or an analogous machine.

A further object of the invention is to provide a simple, compact, rugged and relatively inexpensive braking system which can be installed in or on certain existing attachments for the booms of cranes or the like.

An additional object of the invention is to provide the braking system with novel and improved means for rapidly arresting a descending component of the attachment as soon as the speed of the descending component reaches a value which indicates that the downward movement is not intentional and/or that it is likely to cause injury to the occupant or occupants and/or damage to the attachment or to the machine on which the attachment is mounted.

Still another object of the invention is to provide novel and improved means for protecting the braking system against damage when the system is operated to decelerate and arrest large and heavy components of the attachment.

A further object of the invention is to provide a braking system which prevents strong impacts of the arrested component or components of the attachment against the other component or components which normally support and/or guide the mobile component or components.

The invention resides in the provision of an attachment for the free end portion of the adjustable and/or extensible or contractible boom in a crane or a like machine. The attachment comprises a pivot bearing which is preferably detachably secured to the free end portion of the boom, a second bearing, and an elongated column which is reciprocable in the second bearing and is turnable with the second bearing relative to the pivot bearing about a preferably horizontal axis which is normal to the longitudinal direction of the column. The column is movable in the second bearing up and down at a plurality of speeds, and the attachment further comprises carrier means adjacent to the second bearing (such carrier means may comprise a frame which surrounds the column at a level above or within the second bearing), means for monitoring the speed of downward movement of the column relative to the second bearing and the carrier means, braking means mounted on the carrier means, connected with the monitoring means and operable to arrest the column when the speed of downward movement of the column with reference to the carrier means and the second bearing reaches or exceeds a preselected value whereby the carrier means moves relative to the second bearing during deceleration of the column, and shock absorber means interposed between the second bearing and the carrier means to yieldably oppose the movement of the carrier means with reference to the second bearing.

The monitoring means can comprise an elongated member (e.g., a length of flexible rope or cord) which is installed on and extends lengthwise of the column, and detector means provided on the carrier means and arranged to track the speed of the elongated member.

The column is preferably polygonal, i.e., it has one or more elongated corner portions, and the braking means is preferably operable to apply a braking force to one or more corner portions of the column. To this end, the braking means may comprise a discrete braking unit for each corner portion of the column, and each braking unit can comprise a first brake shoe fixedly mounted on the carrier means and a second brake shoe which is movable against the respective corner portion to thereby urge such corner portion against the fixedly mounted brake shoe.

The novel features which are considered as characteristic of the invention are set forth in particular in the appended claims. The improved attachment itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
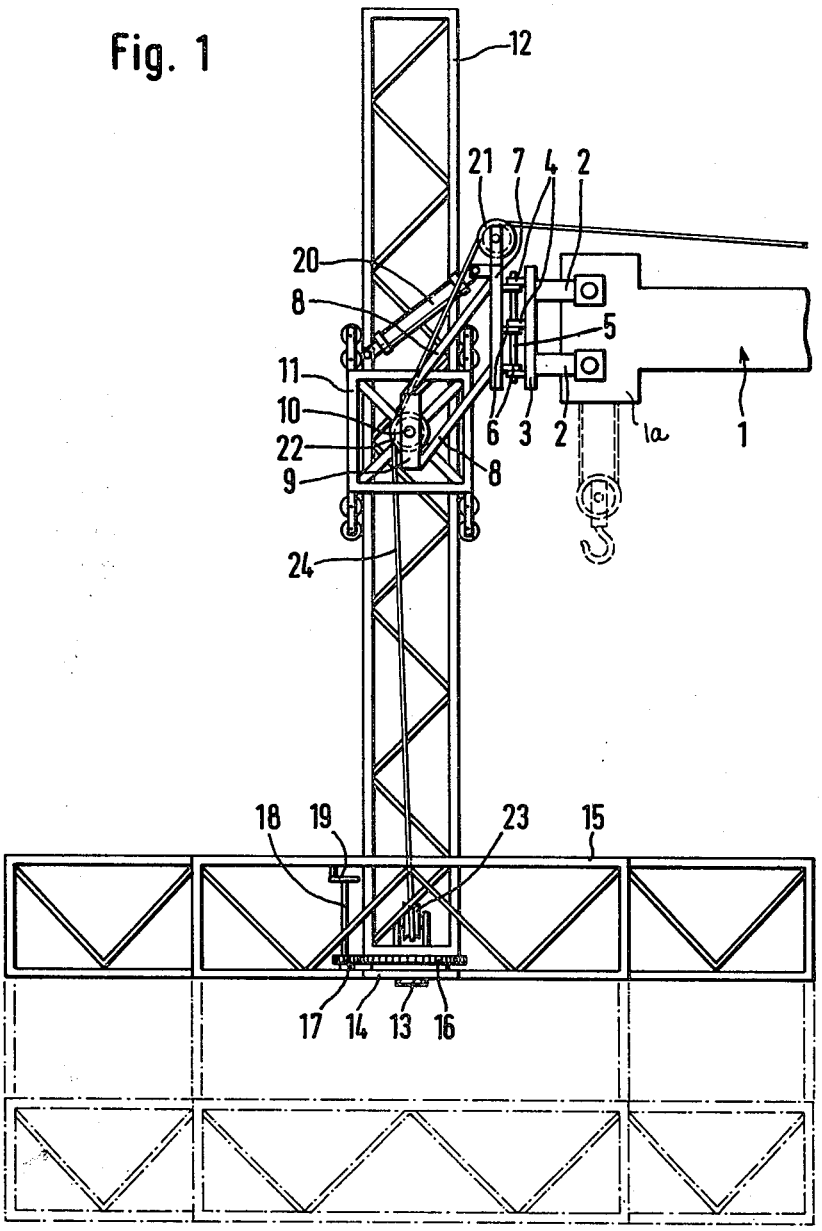
FIG. 1 is a somewhat schematic side elevational view of the improved attachment, and further showing the free end portion of a boom which separably supports the attachment.

Referring first to FIG. 1, there is shown the free end portion 1*a* of an elongated boom 1 which is mounted on the vehicle of a crane or a like machine. The boom 1 is preferably extensible and contractible and is preferably movable about its lower end portion not only in a vertical plane but also about a vertical or nearly vertical axis so that the free end portion 1*a* can be moved to any desired level (as a result of pivoting of the boom 1 in a vertical plane and/or as a result of shortening or lengthening of the boom) as well as that such free end portion can perform an orbital movement at any selected level.

The free end portion 1*a* of the boom 1 is separably or permanently connected with four links or arms 2 (only two shown in FIG. 1) which are rigidly secured to a plate-like coupling member 3. The coupling member 3 is separably connected with a similar second plate-like coupling member 7. To this end, the coupling members 3 and 7 respectively carry projections or lugs 4 and 6 which form two upright rows of the lugs each. Each of the six lugs 4 partly overlies a discrete lug 6, and the lugs 4, 6 of each pair have registering openings for pins, studs, bolts or analogous coupling elements 5. The elements 5 can be withdrawn to allow for separation of the coupling member 7 from the coupling member 3. If desired, the elements 5 can be secured in inserted positions by nuts, cotter pins or the like so as to ensure the establishment of a highly reliable connection between the end portion 1*a* and the coupling member 7 which latter supports all other component parts of the improved attachment.

The attachment further comprises a pivot bearing 9 which is connected to the coupling member 7 by several braces 8 and includes a horizontal shaft 10 defining a pivot axis for a second bearing 11 which slidably guides an elongated column 12 having a polygonal (preferably square or rectangular) cross-sectional outline. The lower end portion of the column 12 is provided with a centrally located or eccentric upright pivot member 13 for a radially outwardly extending platform or holder 14 which, in turn, supports or forms part of a gallery 15 for one or more persons. The gallery 15 may be assembled of two or more sections so that its size can be selected at will, depending on the number of persons to be carried thereby and on the task or tasks which the person or persons occupying the gallery are to perform. If necessary, the gallery 15 can extend around the entire lower end portion of the column 12. It is also possible to mount the gallery at a level above the second bearing 11 or to equip the attachment with several galleries, cages or analogous receptacles including a receptacle above and a receptacle below the bearings 9 and 11. The pivot member 13 is rigid with a relatively large gear 16 which meshes with a smaller gear or pinion 17 rotatably mounted on the holder 14 or gallery 15. The shaft 18 of the gear 17 can be rotated by a handwheel 19 or an analogous implement so as to turn the gallery 15 around the column 12. If desired, the gear 17 can be rotated by a motor which can be started or arrested by a person occupying the gallery 15.

The attachment further comprises means for pivoting the second bearing 11 and the column 12 about the axis of the shaft 10 which latter extends at right angles to the longitudinal direction of the column 12. The pivoting means comprises a motor here shown as a double-acting cylinder and piston unit 20 whose cylinder is articulately connected to an extension of the coupling member 7 and whose piston rod is articulately connected with an extension of the second bearing 11. The purpose of the motor 20 is to enable the occupant or occupants of the gallery 15 (or an automatic regulating system, not shown) to change the inclination of the column 12 relative to the boom 1 so that the column 12 remains substantially upright and the floor or bottom paneling of the gallery 15 remains substantially horizontal regardless of changes in inclination of the boom 1.

The coupling member 7 carries a pulley 21, and the shaft 10 and the lower end portion of the column 12 respectively carry additional pulleys 22 and 23. The crane cable or rope 24 is trained around the pulleys 21–23 and its end portion is provided with a load hook (not shown) which engages the shaft 10. The cable or rope 24 can be driven by a winch (not shown) of the crane so as to move the column 12 up or to allow the column to descend by gravity. It will be noted that, when the crane including the boom 1 is not used in the conventional way (i.e., when the improved attachment is secured to the end portion 1*a* of the boom 1), the cable or rope 24 can serve as a means for effecting lengthwise movements of the column 12.

Figure 2:
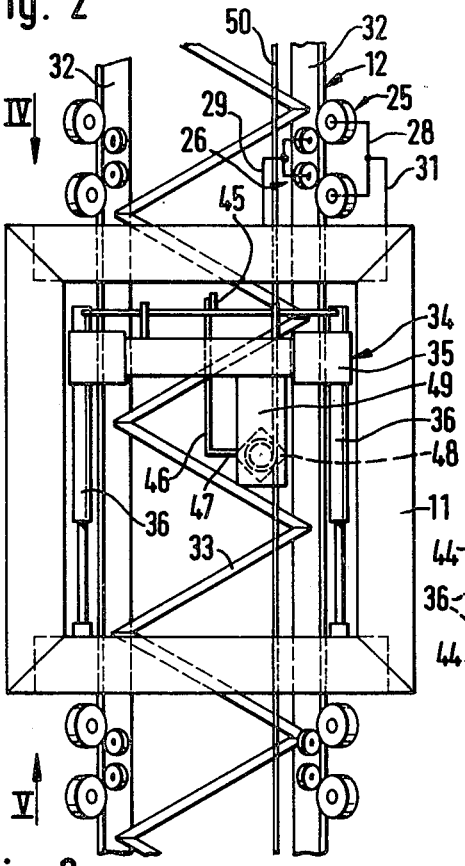
FIG. 2 is an enlarged view of a detail in FIG. 1.
Figure 6:
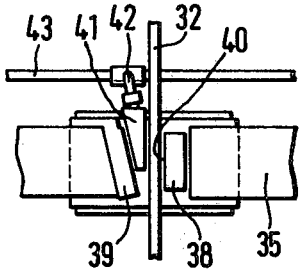
FIG. 6 shows a braking unit as seen in the direction of the arrow VI in FIG. 4.
Figure 4:
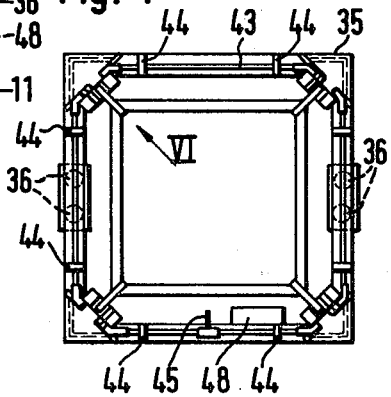
FIG. 4 is a top plan view of the carrier means as seen in the direction of the arrow IV shown in FIG. 2.
Figure 3:
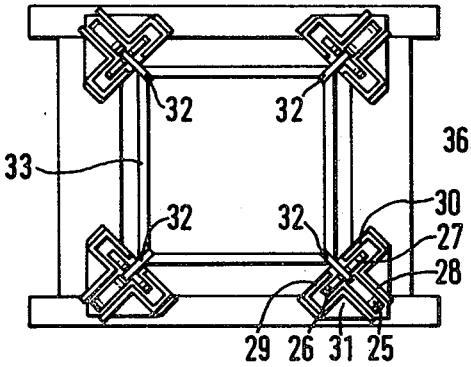
FIG. 3 is a plan view of the structure shown in FIG. 2.
Figure 5:
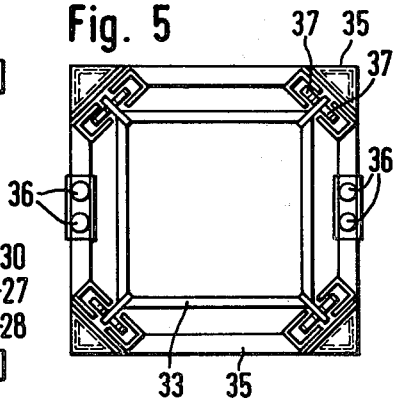
FIG. 5 is a bottom plan view of the carrier means as seen in the direction of the arrow V shown in FIG. 2.

The column 12 comprises four flat rib-shaped or strip-shaped corner members or uprights 32 which are connected to each other by inclined braces 33 so as to form therewith a tubular skeleton of requisite rigidity. The planes of the corner members 32 extend diagonally of the cross section of the column 12 and outwardly of the planes of neighboring braces 33 (see FIG. 3, 4 or 5). Each corner member 32 is guided by three pairs of guide rolls 25, 26, 27 above and by three pairs of guide rolls 25, 26, 27 below the second bearing 11 (see FIGS. 2 and 3). The guide rolls of each of these pairs are mounted in cradles (see the schematically indicated cradles 28, 29 and 30 in FIGS. 2 and 3) which, in turn, are pivotably mounted in mounting means or bearings 31 fixedly secured to the bearing 11. The cradles 28–30 enable the column 12 to turn, within limits, about its own axis for the purposes which will be outlined below. The cradles 28, 29 and 30 can pivot in the corresponding bearing 31 about axes which are parallel to the axes of the respective guide rolls 25, 26 and 27.

The guide rolls 26 and 27 engage the flat major sides of the respective corner members 32, and the guide rolls 27 engage the outer edge faces of the corresponding members 32. Such distribution of rolls 25–27 reduces the play to a minimum and ensures that the column 12 is safely guided from all sides, with a minimum of friction, for movement up and down relative to the bearing 11.

The attachment further comprises a safety device 34 which serves to prevent the column 12 from falling to the ground, e.g., in response to breakage of the cable or rope 24. The safety device 34 comprises a rigid frame-like carrier 35 which surrounds the column 12 at a level above or within the bearing 9. Suitable shock absorbers 36 are provided between the frame-like carrier 35 and the bearing 11 to yieldably oppose the movement of the carrier toward the bearing 11 when the carrier 35 is frictionally coupled to the column 12 because the latter descends at a speed exceeding a preselected value, namely, a value which has been chosen as denoting that the downward movement of the column 12 is not intentional or too fast for the safety of the occupant or occupants of the gallery 15 and/or for the integrity of the attachment. The illustrated attachment comprises four hydraulic shock absorbers 36, one pair between the right-hand corner members 32 and another pair between the left-hand corner members 32, as viewed in FIG. 2. These shock absorbers are commercially available commodities, e.g., of the type used in automotive vehicles.

Additional pairs of guide rolls 37 are interposed between the carrier 35 and the corner members 32 of the column 12. The bearings for the rolls 37 are mounted in and preferably fixedly secured to the carrier 35. These bearings may be adjustably affixed to the carrier 35 so as to allow for elimination of eventual clearances and to ensure that the column 12 can rise or descend with negligible play, and negligible friction, with reference to the carrier 35. By shifting the guide rolls 37 of a pair of such rolls relative to each other, it is possible to change, again within limits, the angular position of the frame-like carrier 35 relative to the longitudinal axis of the column 12.

Each of the four corner portions of the carrier 35 supports, at its upper side, a braking unit including two fixedly mounted brake shoes 38, 39 at the opposite sides of the respective corner member 32 and a mobile brake shoe 41 resembling a wedge and being insertable between the corresponding fixed shoe 39 and the respective corner member 32 to urge the latter against the associated shoe 38. Each shoe 38 has a flat braking or friction generating surface 40 which is adjacent to and parallel with one major side face of the respective corner member 32. The shoes 39 have surfaces which face the adjacent major side faces of the respective corner members 32 but are inclined relative thereto. The wedge-like brake shoes 41 have inclined surfaces which are complementary to those of the brake shoes 39 in the corresponding braking units. As mentioned above, the frame-like carrier 35 can be caused to change its angular position with reference to the longitudinal axis of the column 12 by changing the positions of bearings for selected guide rolls 37. This renders it possible to minimize friction between the surfaces 40 of the brake shoes 38 and the adjacent major side faces of the respective corner members 32, i.e., the extent of contact between the brake shoes 38 and the column 12 is negligible in normal use and condition of the attachment.

The means for moving the wedge-like brake shoes 41 relative to the brake shoes 39 in the respective braking units comprises levers 42 which are articulately connected thereto and can be pivoted by a composite shaft 43 extending all the way around the column 12 at the upper side of the carrier 35. Portions of the shaft 43 are mounted in bearings 44 supported by the carrier 35. The shaft 43 can be rotated by a lever 45 which must be pivoted downwardly in order to turn the shaft 43 in a direction which is needed to produce a braking action, i.e., to drive the wedge-like braking shoes 41 between the fixed brake shoe 39 and the respective corner members 32. This causes the corner members 32 to frictionally engage with the respective brake shoes 38, 41 and to come to a halt, i.e., the column 12 is arrested against further downward movement.

The lever 45 is connected to a rod 46 which is articulately connected with a further lever 47. The lever 47 can be pivoted by a commercially available monitoring device a detector 48 of which is mounted on a plate-like support 49. The monitoring device further comprises a cable, cord or rope 50 which is mounted on and extends lengthwise of the column 12 and is tracked by the detector 48 which pivots the lever 45 via lever 47 and rod 46 when the speed of the cord 50 is excessive, i.e., whenever the speed of downward movement of the column 12 exceeds the aforementioned preselected value. The detector 48 of the monitoring device includes a reel for a portion of the cord 50 so that the angular speed of the reel is indicative of the speed of downward movement of the column 12. As soon as the column 12 descends at an excessive speed, the lever 47 is pivoted downwardly and the rod 46 pivots the lever 45 in the same direction. The lever 45 turns the shaft 43 so that all four wedge-like brake shoes 41 move downwardly and urge the adjacent corner members 32 against the respective fixedly mounted brake shoes 38. The downward movement of the column 12 is terminated practically instantaneously but the shock absorbers 36 take up the resulting impact to avoid damage to the attachment and/or injury to the occupant or occupants of the gallery 15. Also, the shock absorbers 36 reduce the likelihood of damage to or excessive swaying of the boom 1 in response to abrupt termination of downward movement of the column 12. The guide rolls 25–27 between the second bearing 11 and the column 12 are also less likely to be damaged in view of the shock absorbing action of the elements 36. It has been found that the column 12 can be brought to a practically immediate halt on breakage of the cable 24 without any damage to the boom and parts of the attachment and/or injury to the occupant or occupants of the gallery 15. This is due to the provision of the four braking units which can generate surprisingly large braking forces for ensuring practically instantaneous stoppage of the column 12 and to the provision of the shock absorbers 36 which yieldably oppose the movement of the carrier 35 toward the bearing 11 when the braking units terminate the downward movement of the column 12 relative to the carrier 35.

The disclosures of U.S. Pat. Nos. 2,632,530 granted to Wagner on Mar. 24, 1953 and 2,821,312 granted to Wiegel on Jan. 28, 1958 are incorporated herein by reference. These patents disclose mobile cranes or analogous vehicles with booms which are extensible and contractible, pivotable in vertical planes and turnable about vertical axes. The booms can be shortened or lengthened by mechanical or fluid-operated means.

The detector 48 is available by Fritz Lüthi, Aufzügefabrik Lindenholz in 4931 Leimiswil, Switzerland.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a crane or an analogous machine, the combination of a boom having a free end portion; a pivot bearing mounted on said end portion; a second bearing turnable in said pivot bearing about a substantially horizontal axis; an elongated column mounted in and movable up and down relative to said second bearing at a plurality of speeds; carrier means adjacent to said second bearing; means for monitoring the speed of downward movement of said column relative to said second bearing and said carrier means; braking means mounted on said carrier means, connected with said monitoring means and operable to arrest said column when the speed of downward movement of said column rises to a preselected value whereby said carrier means moves relative to said second bearing during deceleration of said column; and shock absorber means interposed between said second bearing and said carrier means to yieldably oppose the movement of said carrier means with reference to said second bearing.

2. The combination of claim 1, wherein said monitoring means comprises an elongated member installed on and extending lengthwise of said column and detector means provided on said carrier means and arranged to track the speed of said member.

3. The combination of claim 2, wherein said elongated member is flexible.

4. The combination of claim 1, wherein said column has at least one longitudinally extending corner portion and said braking means is operable to apply a braking force to said corner portion when said speed rises to said preselected value.

5. The combination of claim 4, wherein said column has a plurality of parallel corner portions and said braking means comprises a plurality of braking units, one for each of said corner portions.

6. The combination of claim 5, wherein each of said corner portions includes a flat rib-shaped member which is engaged by the respective braking unit when said speed reaches said preselected value.

7. The combination of claim 5, wherein said column has four corner portions and said rib-shaped members extend substantially diagonally of and outwardly from said column.

8. The combination of claim 6, wherein each of said members has two parallel flat side faces and each of said braking units comprises a pair of brake shoes engageable with the side faces of the respective member.

9. The combination of claim 4, wherein said braking means comprises a first brake shoe fixed to said carrier means at one side of said corner portion and a second brake shoe located at the other side of said corner portion and movable relative to said first brake shoe.

10. The combination of claim 9, further comprising means for moving said second brake shoe relative to said first brake shoe.

11. The combination of claim 4, wherein said corner portion has an elongated side face and said braking means comprises a first brake shoe fixed to said carrier means and having a first surface inclined with reference to said side face and a second brake shoe having a second surface complementary to said first surface, said second shoe being movable between said corner portion and said first shoe.

12. The combination of claim 11, further comprising means for connecting said second brake shoe with said monitoring means including shaft means rotatably mounted on said carrier means.

13. The combination of claim 12, wherein said monitoring means includes detector means for the speed of downward movement of said column and means for rotating said shaft means to thereby engage said second shoe with said first shoe and said corner portion when the detector means ascertain that the speed of downward movement of said column reaches or exceeds said preselected value.

14. The combination of claim 13, wherein said means for rotating said shaft means comprises lever means.

15. The combination of claim 14, wherein said column comprises a plurality of corner portions and said braking means comprises a discrete braking unit for each of said corner portions, each of said units comprising a first and a second brake shoe and said shaft means being common to all of said second brake shoes, extending around said column and being turnably mounted on said carrier means.

16. The combination of claim 15, wherein said means for connecting said second brake shoes with said monitoring means further comprises levers pivotable by said shaft means and arranged to move said second brake shoes relative to the respective first brake shoes in response to rotation of said shaft means.

17. The combination of claim 1, wherein said column has at least one longitudinally extending corner portion and guide means provided on said second bearing for said corner portion.

18. The combination of claim 17, wherein said guide means comprises rolls provided on said second bearing at levels above and below that portion of the column which is engaged by said second bearing.

19. The combination of claim 17, wherein said corner portion includes an elongated rib-shaped corner member having two side faces and an edge face and said guide means includes at least one pair of guide rolls for each of said faces.

20. The combination of claim 19, further comprising cradles for said pairs of guide rolls and means for movably mounting said cradles on said second bearing.

21. The combination of claim 20, wherein each of said cradles is pivotable in the corresponding mounting means about an axis which is parallel to the respective guide rolls.

* * * * *